US010766114B2

(12) United States Patent
Junker

(10) Patent No.: US 10,766,114 B2
(45) Date of Patent: Sep. 8, 2020

(54) METHOD AND SYSTEM FOR GRINDING THE EXTERIOR OF SHAFT PARTS BETWEEN TIPS

(71) Applicant: ERWIN JUNKER GRINDING TECHNOLOGY A.S., Melnik (CZ)

(72) Inventor: Erwin Junker, Buehl/Baden (DE)

(73) Assignee: ERWIN JUNKER GRINDING TECHNOLOGY A.S., Melnik (CZ)

( * ) Notice: Subject to any disclaimer, the term of this patent is extended or adjusted under 35 U.S.C. 154(b) by 424 days.

(21) Appl. No.: 15/564,684

(22) PCT Filed: Apr. 8, 2016

(86) PCT No.: PCT/EP2016/057856
§ 371 (c)(1),
(2) Date: Oct. 5, 2017

(87) PCT Pub. No.: WO2016/166036
PCT Pub. Date: Oct. 20, 2016

(65) Prior Publication Data

US 2018/0085881 A1 Mar. 29, 2018

(30) Foreign Application Priority Data

Apr. 13, 2015 (DE) ..... 10 2015 206 565

(51) Int. Cl.
*B24B 5/04* (2006.01)
*B24B 41/06* (2012.01)
(Continued)

(52) U.S. Cl.
CPC ..... *B24B 5/04* (2013.01); *B24B 5/01* (2013.01); *B24B 5/22* (2013.01); *B24B 41/067* (2013.01); *B24B 49/04* (2013.01)

(58) Field of Classification Search
CPC ..... B24B 49/04; B24B 41/06; B24B 5/04; B24B 5/22; B24B 5/01; B24B 41/067
(Continued)

(56) References Cited

U.S. PATENT DOCUMENTS 3,418,763 A * 12/1968 Soderquist, V ..... B24B 5/185 451/28
3,427,755 A * 2/1969 Neil ..... B24B 41/065 451/243
4,205,488 A 6/1980 Englander et al.

FOREIGN PATENT DOCUMENTS

DE 2927650 A1 1/1980
DE 4036283 A1 5/1992
(Continued)

OTHER PUBLICATIONS

International Search Report for international application No. PCT/EP2016/057856, dated Jun. 30, 2016.
(Continued)

*Primary Examiner* — George B Nguyen
(74) *Attorney, Agent, or Firm* — Marshall, Gerstein & Borun LLP

(57) ABSTRACT

A system and method for grinding the exterior of a shaft part with rotationally symmetrical sections and bases which have centering bores and which define a reference longitudinal axis and rotational axis of the shaft part. The shaft part is held between tips which engage into the centering bores during the grinding process using a grinding disk, and the shaft part is additionally supported on the rotationally symmetrical sections by means of a support device. The current diameter values of the rotationally symmetrical sections are measured and transmitted to a controller, by means of which the support device is updated with respect to the measured
(Continued)

diameter values while continuously supporting the rotationally symmetrical sections until target dimensions are achieved.

18 Claims, 7 Drawing Sheets

(51) Int. Cl.
*B24B 49/04* (2006.01)
*B24B 5/01* (2006.01)
*B24B 5/22* (2006.01)

(58) Field of Classification Search
USPC ..... 451/49
See application file for complete search history.

(56) References Cited

FOREIGN PATENT DOCUMENTS

| | | | |
|---|---|---|---|
| DE | 102007023894 | A1 | 11/2008 |
| DE | 102012223276 | A1 | 6/2014 |
| EP | 0211539 | A2 | 2/1987 |
| EP | 1955808 | A1 | 8/2008 |
| GB | 2108024 | A | 5/1983 |
| JP | 2002120147 | A | 4/2002 |
| WO | WO-2014103806 | A1 | 7/2014 |

OTHER PUBLICATIONS

Written Opinion of international application No. PCT/EP2016/057856, dated Jun. 30, 2016.

* cited by examiner

Ansicht X

Schnitt A - A

Schnitt A - A

Ansicht X (Variante)
2
2'
3
4
10
11
12
13
14
15
25
30
30'
31
32
33
Z1
Z2

Schnitt 8 – 8

METHOD AND SYSTEM FOR GRINDING THE EXTERIOR OF SHAFT PARTS BETWEEN TIPS

CROSS-REFERENCE TO RELATED APPLICATIONS

This is the United States national phase of International Patent Application No. PCT/EP2016/057856, filed Apr. 8, 2016, which claims the priority benefit of German Application No. 102015206565.0, filed Apr. 13, 2015. Each of the foregoing is expressly incorporated herein by reference in the entirety.

BACKGROUND

The invention relates to a method for grinding the exterior of a shaft part with rotationally symmetrical sections and end surfaces which have centering bores, as well as to a system composed of a grinding machine and such a shaft part.

In grinding technology, fundamentally two different technologies exist, which also require different grinding machines, and the grinding methods of which differ fundamentally from one another. For one thing, this is grinding between tips, in which a workpiece to be ground is usually held, during the grinding process, between a tip disposed on the workpiece headstock and a tip disposed on the opposite tailstock. The workpiece can be driven to rotate either by means of the friction of the tip on the workpiece headstock side in the center, or by means of separate drivers, or by means of a clamping chuck having equalizing clamping jaws. For such grinding between tips it is necessary, particularly in the case of longer workpieces, which demonstrate a certain flexibility with regard to possible bending, to support these at one or more locations of the workpiece during grinding, by means of bezels, in order to obtain an appropriately good quality of the grinding result.

A second fundamental grinding method is what is called centerless grinding. In centerless grinding, the workpiece is not held between tips; instead, it is put into rotation by means of a grinding disk and a regulation disk that lies opposite to the former, for grinding or during grinding, wherein what is called a support ruler is provided in the grinding gap between the grinding disk and the regulation disk, under the workpiece, on which ruler the workpiece is supported during grinding. Such a centerless grinding method is particularly suitable for grinding the exterior of rotationally symmetrical workpieces or workpieces having rotationally symmetrical sections, which workpieces are provided in great numbers for mass production. The disadvantage in centerless grinding consists in that the relationship with centering no longer exists in the case of tip-free grinding.

In DE 10 2008 045 842 B4, a method and a grinding machine for grinding elongated workpieces are known. With this known grinding machine and this known method, elongated rotationally symmetrical workpieces are ground by means of two opposite grinding disks that engage at the same time, wherein because of their opposite rotation, the workpiece is pressed against a support device disposed laterally in the grinding gap between the grinding disks. In this regard, the workpiece is clamped between tips, and this is possible because the grinding forces of the opposite grinding disks cancel one another out. The workpiece is pressed against the support element by means of the forces that occur during cutting. This is therefore passive support, because not only the grinding disks but also the support element is/are positioned in the same way, so that the forces that act on the workpiece in the tangential direction cancel one another out. The equal positioning of grinding disks and support element allows no reaction of the system to deviations between reference diameter and actual diameter. As a result, limits are set for the precision that can be achieved.

In the online article of the may company, a cylindrical grinding machine for grinding between tips and for tip-free grinding is described. The combination of grinding between tips and centerless grinding is supposed to lead to a significant reduction in the machining time, with a simultaneous increase in quality as compared with grinding only between tips. In the known machine, a predetermined amount of material is ground away during grinding between tips. In order to subsequently be able to grind in centerless manner, clamping of the workpiece between the tips is released, and subsequently, the centerless grinding process is carried out. In known manner, in this regard, the workpiece is driven by the regulation disk and supported on every seat. When the centering tips retract for the purpose of releasing the tips from the workpiece, the workpiece drops to the contact rail disposed in the grinding gap. Even in this regard, it is not ensured that the relationship with centering, which is predetermined by means of clamping between the tips, is maintained or even maintained only within low tolerances, because a change in reference takes place during the grinding process.

Furthermore, in a press release dated Feb. 22, 2006, on the internet, an article regarding a "Kronos I dual" grinding machine is described, with which both centerless grinding and grinding between tips is possible in one machine. In this regard, however, the workpiece is also first ground between the tips, and afterward, the workpiece is released from the clamping between tips, and finishing grinding is carried out by means of centerless grinding. Here, too, the relationship with centering is given up in the transition from grinding between tips to centerless grinding, and therefore precision losses are connected with this, since the aforementioned change in reference during grinding takes place.

The known grinding machine Kronos L dual uses both grinding methods, grinding between tips and centerless grinding, on one machine. In this regard, pre-grinding takes place between tips, during which a clean, cylindrical outer surface is produced on the rotationally symmetrical sections. After completion of pre-grinding between tips, the tips are released, and centerless grinding follows. As a result, a new relationship of what is called the center occurs, specifically by way of the clean, cylindrical surfaces of the rotationally symmetrical sections, which were produced during pre-grinding. Therefore, a certain preservation of the center of the workpiece is achieved, but this is not sufficient for the highest quality demands, because what is called the center is only maintained to the extent that it permits the precision of the clean, cylindrical surfaces of the rotationally symmetrical sections of the workpiece produced during pre-grinding.

Using the known machine, the grinding process is interrupted after pre-grinding, in any case, and after the subsequent release of the tension between the tips, when the tip tension on the workpiece is released. This is then followed by the newly started centerless grinding. This means that aside from the change in the reference longitudinal axis of the workpiece, the grinding time is extended.

On the other hand, the disadvantage consists in that because of the clear technological separation between grinding between tips and centerless grinding, the workpieces are not reliably supported during grinding between tips, neither by the contact ruler nor by the regulation disk that is generally present during centerless grinding. Therefore, difficulties can occur during grinding, particularly in the case of long, thin shafts, which are relatively flexible and unstable.

If, furthermore, particularly in the case of long and thinner workpieces, grinding is to take place between tips, it is usual to provide bezels for additional support. For this purpose, however, it is necessary that corresponding bezel seats must be ground on before the bezels can be set onto the workpiece. Grinding of the bezel seats requires an additional expenditure of time, which is all the greater, the longer the workpieces to be ground are, because in the case of longer workpieces, more bezel seats generally have to be ground. Self-centering bezels have the property that the workpiece is clamped so as to be centered in the three bezel jaws. This clamping during support has the disadvantage that optical running tracks are retained at the support location of the bezels, on the finished, ground, rotationally symmetrical section.

An additional problem in grinding between tips arises from the fact that when setting multiple bezels, these possess a different thermal growth, in each instance, even if this lies only in the μm range. Because of this different thermal growth, imprecisions can be additionally introduced into the grinding process.

GENERAL DESCRIPTION

In contrast, the task of the invention consists in making available a method for grinding the exterior of a shaft part with rotationally symmetrical sections, as well as a system composed of a grinding machine and such a shaft part, which system implements the method, by means of which system the advantages of grinding between tips can be utilized, wherein in particular, maintaining a precise reference axis during grinding plays a role, in order to be able to implement high quality of the grinding result on the ground workpiece without additional bezels having to be used, even in the case of workpieces that demonstrate a certain flexibility with regard to their longitudinal axis.

According to a first aspect of the invention, grinding of the exterior of a shaft part that has rotationally symmetrical sections and end surfaces in which centering bores are introduced is implemented in the method according to the invention. The centering bores define a reference longitudinal axis and axis of rotation of the shaft part, which axes must still be present after grinding for great precision of the shaft part, or are of significant importance for subsequent machining processes. This means that the reference axis of the shaft part defined by the centering bores is maintained during grinding work. According to the invention, it is now provided that during grinding by means of a grinding disk, the shaft part is held between tips that engage into the centering bores, and is supported on the rotationally symmetrical sections by means of a first and a second support apparatus. A measurement device records diameter values of the rotationally symmetrical sections of the shaft part. These measurement values are transmitted to a controller that causes the support device to update the measured, actual diameter values, up to the finished dimension of the shaft part, with continuously ongoing support of the rotationally symmetrical sections. This represents active positioning of the support device at the current diameter of the rotationally symmetrical section of the shaft part that has just been ground. Grinding machining is preferably essentially the entire grinding machining. However, a certain pre-grinding of the workpiece when it has not yet been clamped between the tips is included in this. In any case, however, a significant part of the grinding, including up to the end of the finishing grinding between tips, is carried out with the support device set and updating the progress of grinding.

It is advantageous if during this grinding between tips, the result is achieved, by means of the supports and the simultaneous grinding, that workpieces with high quality with regard to dimensional tolerances, shape tolerances, and position tolerances are produced.

Furthermore, no running traces of bezels on the surface will be seen on the workpiece, since the support on the workpiece is carried out in a corresponding width, and no "clamping forces" act on the support seat as in the case of self-centering bezels.

This means that the entire grinding process is grinding between tips and—in contrast to the state of the art—specifically is not followed by centerless grinding. Instead, during the entire grinding process, a support apparatus is set against the rotationally symmetrical sections and made to update the current diameter, in each instance, when material is removed at the grinding location. It is true that the support apparatus is configured in the manner as is known for centerless grinding. Nevertheless, the method according to the present invention is not a method step of centerless grinding. Use of the support apparatus ensures, while maintaining the reference plane, by means of permanent grinding between the tips, that bezels are no longer necessary and that not only the advantages of grinding between tips but also the advantages of support, as it is reminiscent of centerless grinding, at least fundamentally, can be utilized. However, loosening of the clamping between the tips is not provided during any phase of the entire grinding process, according to the invention.

Preferably, the support device in the form of the first and second support unit is configured as a support disk or a contact ruler. The main task of the support disk consists in that during grinding between tips, support takes place at all parts of the shaft part on which rotationally symmetrical sections are present, if possible. The shaft part is situated between grinding disk and support disk, wherein the resulting grinding gap is closed, in the downward direction, by means of a contact ruler on which the shaft part is supported during grinding between tips. As a result, the shaft part experiences support at least on central regions of its length, but always remains clamped between tips during the entire grinding process.

Furthermore preferably, the shaft part is driven rotationally. This preferably takes place by means of tips that engage into the centering bores, or special drivers, or a clamping chuck, which are adapted to the geometry of the workpiece.

The support disk is now configured in such a manner that when it is set against the shaft part, no slip occurs between the support disk and the shaft part, i.e. the support disk and the shaft part run essentially without slip relative to one another.

In order to obtain optimal support conditions and grinding conditions during grinding, it is furthermore preferably provided that the grinding disk, the shaft part, and the support disk are regulated with regard to their respective speed of rotation. Regulation of the speed of rotation can be used to ensure that no slip occurs between support disk and shaft part, but on the other hand, the grinding disk produces optimal grinding engagement conditions on the shaft part. It can preferably also be provided that the shaft part is driven or braked during finishing grinding, both by means of the grinding disk and the support disk. Furthermore preferably, the support disk is provided with a coating that is configured in the manner for a grinding disk, wherein the support disk is disposed opposite the grinding disk and performs its support function there, namely supports the shaft part, but does not grind.

A further embodiment is that the support disk is produced from steel or hard metal, for example. In this way, the support disk can be configured to be very wear-resistant.

In order for the support device to be made to update the currently measured diameter values, in each instance, down to the finished dimension of the shaft part, as the invention prescribes, measuring the diameter values preferably takes place by way of in-process measurement. In this way, corrective action on the grinding process and thereby on the grinding result can be taken immediately at every currently measured diameter.

In order to continuously measure the diameter of the shaft part or workpiece, the diameter is measured on at least one end of the shaft part. With this measured diameter value, the setting value of the grinding disk, of the support disk, and of the contact ruler is then regulated.

Usually, however, the workpiece is measured at both shaft ends, at their diameters. In this way it is possible that for one thing, the diameter of the workpiece can be continuously measured at both shaft ends, and thereby also the conicity deviation of the workpiece can be determined by means of the difference between the measured values.

In order to be able to produce a precise cylindrical shape or a targeted conicity of the workpiece, in a preferred embodiment the grinding disk and the support disk are structured so that they can pivot automatically, under CNC control, in each instance, with regard to their axes in the horizontal plane. In order to lay the support device (contact ruler) against the workpiece, this device or the contact ruler has setting devices at both its ends, to set it against the workpiece, so that the contact ruler can be inclined relative to the center axis, in targeted manner, by means of different setting amounts. In this way, it is possible that by means of different setting amounts at the ends, the contact ruler can be set against the workpiece with precise alignment with the center axis of the workpiece, or at a slant, in targeted manner.

According to a further development, the support device has two contact rulers, which are adjusted relative to one another and are configured in the form of a prism. In this case, the two contact rulers represent the first support unit and the second support unit. As a further development of the method according to the invention, it is provided that the grinding disk and the shaft part are moved axially relative to one another, and that in this regard, the shaft part is ground, at least partly parallel, in terms of time, on the rotationally symmetrical section and also on a flat side, next to a rotationally symmetrical section.

According to yet another aspect of the invention, a method for grinding the exterior of a shaft part with rotationally symmetrical sections and with centering devices affixed to its end surfaces is implemented by means of centering devices that define a reference longitudinal axis and rotational axis. By means of the method according to the invention according to this aspect of the invention, it is ensured that during grinding machining of the shaft part, up to and including finishing grinding, the shaft part ground with a grinding disk is held clamped between the tips that engage into the centering devices, and, at the same time, both a contact rail and a regulation disk or a further contact rail in place of the regulation disk are made to update a respective currently ground diameter, in constant engagement with the shaft part. Fundamentally, the shaft part or workpiece is held between tips, at least during the essential part of the grinding process with the grinding disk. In order for the reference longitudinal axis and the rotational axis to be maintained without change during a grinding process, up to the end of finishing machining, the workpiece or shaft part is permanently held between tips. Provision of a regulation disk and a contact rail fundamentally corresponds to an arrangement for centerless grinding. According to the present invention, however, no centerless grinding takes place, since the shaft part is held clamped between tips during grinding. Nevertheless, a regulation disk and a contact rail are provided in order to correspondingly support the shaft part on tips during grinding. In this way, it is possible to achieve a high-precision grinding result even for relatively bendable or flexible workpieces, without providing support bezels. This represents a surprising result, because the two fundamental technological grinding methods, namely grinding between tips and centerless grinding, are combined, in the method according to the invention, in such a manner that during grinding up to the end of finishing grinding, grinding between tips takes place, without the tips being released and—as is known in the state of the art—a transition to centerless grinding coming about.

In this way, a completely new path has been shown for grinding the exterior of shaft parts with rotationally symmetrical sections. Although the fundamental basic structure or fundamental sequence of the method according to the invention, with a regulation disk or further contact rail in place of the regulation disk and a contact rail, is fundamentally reminiscent of centerless grinding, this does not take place, according to the invention, because the workpiece is clamped between tips during grinding, up to the end of finishing grinding. By means of providing a contact rail and a regulation disk or a further contact rail in place of the regulation disk, it is possible to eliminate support bezels even for relatively flexible, long workpieces, and to nevertheless achieve great precision of such workpieces.

Preferably, the regulation disk and the shaft part, particularly a rotationally driven shaft part, run essentially without slip relative to one another. By means of the slip-free running, the result is achieved, above all, that the regulation disk represents a reliable support function with regard to the grinding forces introduced into the shaft part during grinding by means of the grinding disk, and that therefore the regulation disk cannot leave any surface markings, as this is generally the case for support bezels. This is because the regulation disk engages precisely at the locations at which grinding takes place.

In order to achieve optimal grinding results, i.e. high quality of the ground shaft parts, the grinding disk, the shaft part, and the regulation disk are preferably regulated in terms of the speed of rotation. In this way, optimal speed of rotation conditions can be set with regard to the grinding process.

Furthermore preferably, the shaft part is driven by the grinding disk and by the regulation disk during finishing grinding, wherein the grinding disk and the regulation disk form a grinding gap in which the shaft part is disposed, supported on the contact rail. This fundamental structure and the method implemented with it are similar to those in centerless grinding, wherein, according to the invention, centerless grinding does not take place at all.

According to a further development of this aspect of the invention, the contact rail as well as the further contact rail provided in place of the regulation disk are adjusted relative to one another, wherein the two contact rails form a prism that is made to update the respective current ground diameter as a support device.

Preferably, the respective current ground diameter of the rotationally symmetrical sections is measured by means of an in-process measurement, and, in this regard, is particularly used, by way of a controller, to control the updating of the ground, rotationally symmetrical section of the shaft part. In the in-process measurement, measuring can take place at one diameter or at multiple diameters of the ground, rotationally symmetrical section. The measurement values obtained in this manner are used for control of updating.

According to a further aspect of the invention, the system according to the invention, which consists of a grinding machine and a shaft part, and is provided, for grinding of the exterior of the shaft part, with rotationally symmetrical sections and end surfaces as well as centering bores that define a reference longitudinal axis and a rotational axis of the shaft part, has a grinding disk that is disposed on a grinding spindle, rotationally driven by way of a CNC axle, a workpiece headstock, and a tailstock with a second tip. The shaft part is clamped or held by means of the first and the second tip during grinding, and driven so as to rotate about a reference longitudinal axis that is thereby defined. During the entire grinding process, the shaft part is permanently held or clamped. A support device with a first and second support unit that can be adjusted relative to one another as well as a measurement device for measuring the current diameter of rotationally symmetrical sections of the shaft part are provided in the system according to the invention. Measurement signals of the current diameter of the rotationally symmetrical sections of the shaft part are passed on to a controller and can be passed on by the latter, wherein the first and second support unit can always be updated with respect to the current diameter of the rotationally symmetrical section at which the current diameter has just been determined by the measurement device, on the basis of these measurement values, in such a manner that the shaft part is doubly supported by means of the support unit that lies opposite the grinding disk and when the tips are in engagement.

This means that during the entire grinding process, the first and second support unit are also not only in constant contact with the respective rotationally symmetrical section of the shaft part, but also the first and second support unit can be updated with respect to the respective current diameter of the respective rotationally symmetrical section. Updating within the scope of the present invention should be understood to mean that the respective support unit is set against the respective rotationally symmetrical section in such a manner, and controlled in this regard in such a manner that an optimal support function of the shaft part is guaranteed, but on the other hand, the support pressure is not so high that an overly great friction resistance has a detrimental effect on the grinding forces to be introduced and on the grinding result as a whole. In order for the friction forces to be low right from the start, and optimized with regard to the support process, it is furthermore provided that preferably friction-reducing surface coatings are disposed or provided on the support units, which coatings support the workpiece over their length, or that these are structured in such a manner, in part, that only certain regions of the support disk support the workpiece.

Preferably, the first support unit supports a support disk, whereas the second support unit is a contact ruler. In this regard, the contact ruler is configured in such a manner as it is fundamentally used in centerless grinding.

According to a further development of the system, it is provided that the grinding disk, the support disk, and the workpiece headstock that clamps the shaft part in place together with the tailstock each have an independent CNC drive, on the basis of which the respective speed of rotation can be regulated under CNC control.

Furthermore preferably, the support disk sits on a spindle and is preferably configured to be divided, wherein each part can be updated with respect to the current diameter of corresponding rotationally symmetrical sections of the shaft part, with simultaneous support of these rotationally symmetrical sections.

According to a further development, it is also possible that both the first and the second support unit are a contact ruler, in each instance, which contact rulers can be moved relative to one another, forming a prism-like support region on the rotationally symmetrical section of the shaft part.

And finally, the measurement device is preferably configured as an in-process measurement device, by means of which current diameters can be measured during ongoing grinding.

BRIEF DESCRIPTION OF THE DRAWINGS

Further advantages and details of the present invention will now be explained using exemplary embodiments and making reference to the following drawings. The figures show.

DETAILED DESCRIPTION

Figure 1:
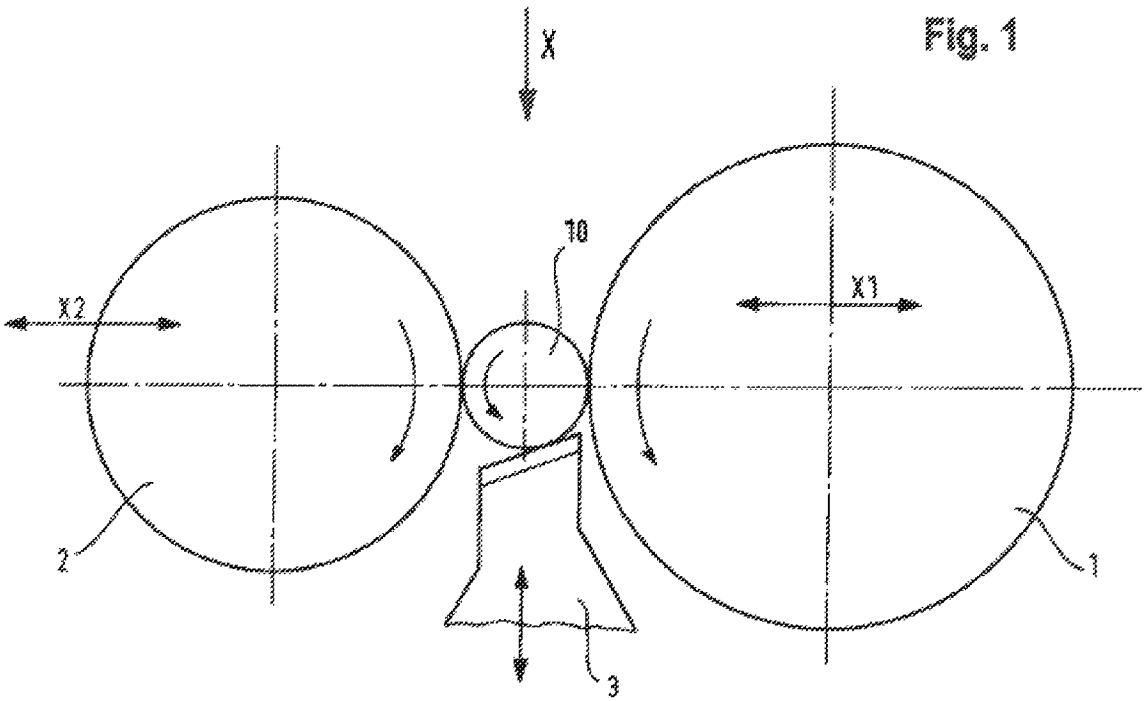
FIG. 1: a fundamental side view of the system consisting of grinding machine and shaft part.

In FIG. 1, the system according to the invention, composed of the grinding machine and the shaft part or workpiece 10, is shown in a side view. A grinding disk 1 that can be positioned in the X1 direction is in engagement with the shaft part 10. A support disk 2, which can be positioned against the shaft part 10 along an X2 setting axis, and is in engagement with it, is provided lying opposite the grinding disk 1. The support disk 2 represents a first support unit. The shaft part 10 in turn is supported on a second support unit in the form of a support ruler 3. The support ruler 3 can also be set against the respective current ground diameter of the shaft part 10 by way of a CNC axle. This means that the support ruler can constantly be updated with respect to the current ground diameter.

It is true that this fundamental structure according to FIG. 1 looks similar to an arrangement for centerless grinding at first glance. However, according to the present invention, no centerless grinding is carried out on the grinding machine that belongs to the system according to the invention, because the shaft part 10 is held between tips—not shown in FIG. 1—during the entire grinding process shown in FIG. 1.

The grinding disk is mounted on a grinding spindle 4 (not shown), which is rotationally driven by a drive motor, also not shown. The grinding spindle drive is equipped with a speed of rotation regulator that is controlled by a CNC controller of the grinding machine of the system according to the invention, which is also not shown in FIG. 1 for the sake of simplicity. The setting axles X1 for the grinding disk 1 and X2 for the first support unit, configured as the support disk 2, are configured as CNC axles, in each instance. The support disk 2 is set onto a support spindle 5 (not shown), which in turn is driven by a drive motor that is also not shown, with regulation of the speed of rotation, wherein the support spindle 5 is mounted on a support headstock (not shown), which can be moved along the CNC-controlled X2 axis that is shown.

Figure 2:
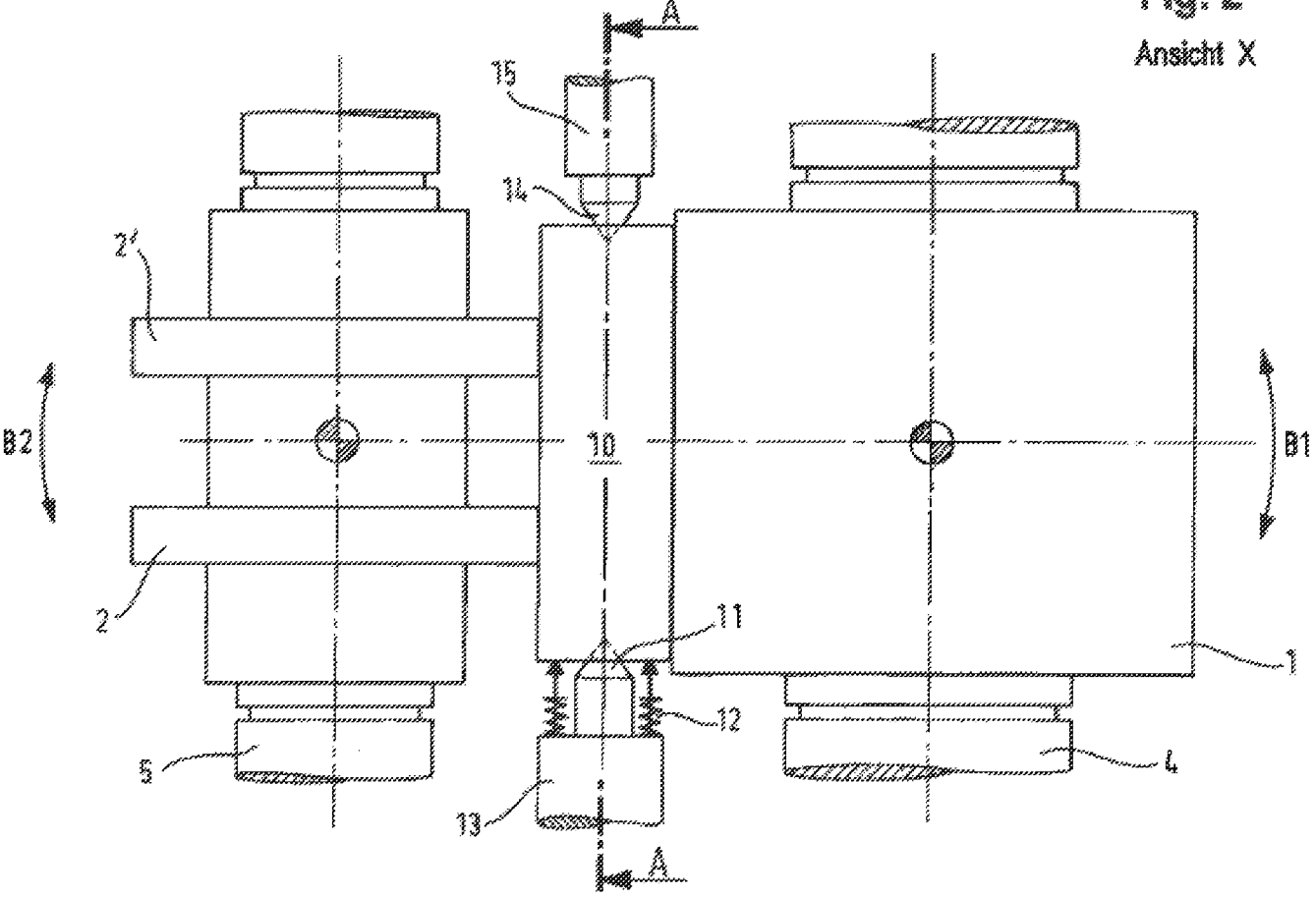
FIG. 2: a top view of the grinding machine with shaft part according to the invention, in a viewing direction X according to FIG. 1.

FIG. 2 represents the fundamental arrangement of the system according to the invention, which comprises the grinding machine and the shaft part, in a viewing direction X according to FIG. 1. From FIG. 2, it is evident that the shaft part 10 is clamped in place between a tip 11 of a workpiece headstock 13 and a tip 14 of a tailstock 15. Rotational drive of the shaft part 10 takes place by means of a driver 12. During the entire grinding process, the workpiece 10 remains clamped between the tips 11, 14. The tip 11 and the driver 12 of the workpiece headstock 13 are rotationally driven by a CNC-controlled motor, with regulation of the speed of rotation. After the shaft part 10 has been clamped in place between the tips 11, 14, the driver 12 ensures that the shaft part 10 will be driven rotationally, by means of form-fitting engagement with it. At the same time, the grinding disk 1 of the grinding headstock and the support disks 2, 2' and the support ruler 3 (not shown) are positioned by way of corresponding CNC-controlled axles. Two support disks 2, 2' are disposed on the support spindle and set against the shaft part 10 in its center region, so that this part is supported at two locations between the tips 11 and 14. The support disks 2, 2' partially take on a support function in the center region of the shaft part 10, so to speak. As compared with centerless grinding or the arrangement that implements centerless grinding, in which the regulation disk that is present there is disposed over the complete workpiece length, since the regulation disk also takes on a driving or braking function for the workpiece during grinding in the case of centerless grinding, in the case of the solution according to the invention, drive of the shaft part 10 is implemented by way of the drivers disposed on the workpiece spindle 13. The support function of the support disks 2, 2' shown in FIG. 2 ensures reliable grinding of the rotationally symmetrical sections, with permanent clamping between the tips 11, 14, specifically without bezels having to be provided. In this regard, the support disks 2, 2' are particularly configured as low-wear disks made of hardened steel or of hard metal. Great quality demands are made on the support disk, above all with regard to having a particularly low concentricity error. Otherwise, the concentricity error could lead to a poorer grinding result, specifically in spite of the permanent clamping of the workpiece or shaft part 10 between the tips 11, 14. Holding the shaft part 10 between the tips 11, 14 offers sufficient rigidity so that the shaft part 10 does not have to be specially supported in the region of the tips 11, 14.

In order to be able to automatically set or implement targeted conicity on the workpiece or shaft part by means of the grinding disk and/or the support disk during grinding, the grinding spindle 4 with the grinding disk 1 and the support spindle 5 with the support disks 2, 2' are mounted on a pivot axle, in each instance, so that the spindles can be pivoted in the horizontal plane. The respective pivoting movements or pivot axles are identified as B1 and B2, respectively.

By means of this method of procedure, it is possible for a precise cylinder shape or a targeted conicity to be ground on the workpiece. This embodiment with the two pivot axles is a preferred, non-compulsory embodiment (not shown).

Figure 3:
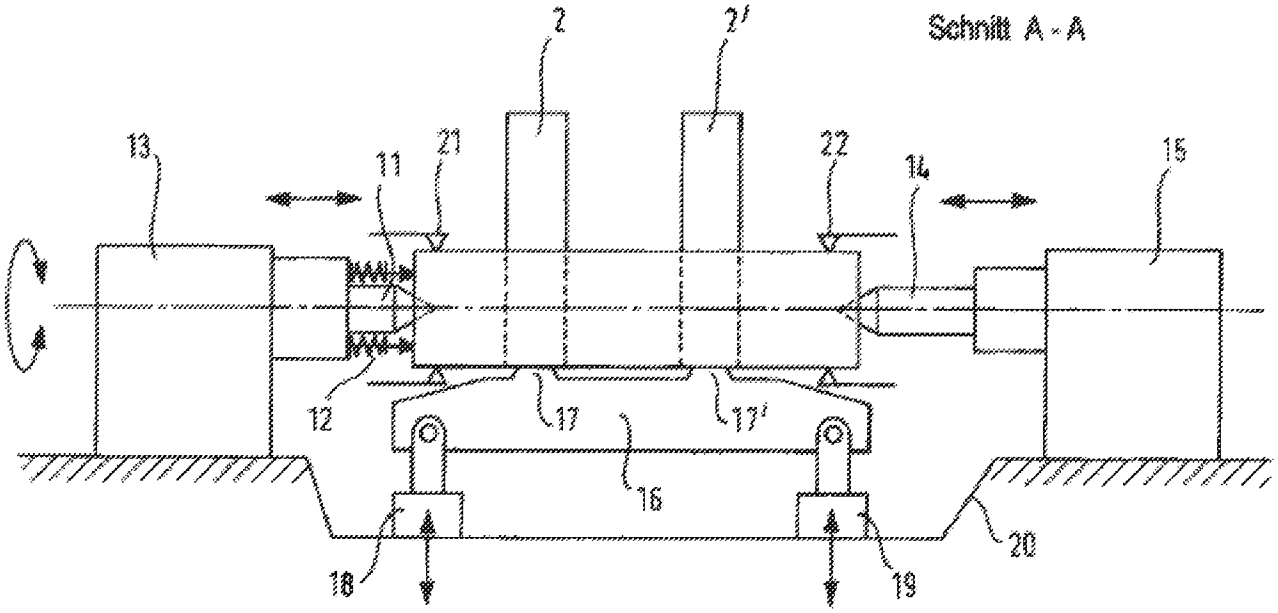
FIG. 3: a view of the grinding machine with shaft part according to the invention, along the section plane A-A according to FIG. 2.

FIG. 3 shows a view along the section plane A-A according to FIG. 2. The second support unit, not shown in FIG. 2, is shown in the form of a support ruler 16 in FIG. 3. This support ruler or contact ruler 16, configured as a support rail, has separate support regions 17, 17' and is set against the shaft part 10 by means of two drives, each CNC-controlled, at the current diameter that has just been ground. During its clamping between the tips 11, 14, the shaft part 10 partially lies on the contact ruler 16, on its support regions 17, 17'. The grinding headstock, not shown, the support headstock, also not shown, the workpiece headstock 13, the tailstock 15, and the support ruler or support rail 16 with the drives 18, 19 are all mounted on a common machine bed 20. In this way, the required rigidity is guaranteed, so that when the method according to the invention or the system according to the invention, consisting of grinding machine and shaft part, are used, the greatest possible precision for the shaft part can be achieved. In order to be able to set the support disks 2, 2' and the support ruler 16 precisely against the shaft part 10, in accordance with the respective current diameter, an in-process measurement head 21 is disposed on at least one of the two ends of the shaft part 10. In the embodiment according to FIG. 3, in-process measurement heads 21, 22 are disposed on both shaft ends. With these measurement heads 21, 22, the respective current diameter of the shaft part can be continuously detected during grinding. The measured diameter values recorded with them are transmitted to a machine controller, not shown. On the basis of these measurement values, the machine controller controls the support disks 2, 2' and the support ruler 16 continuously, in accordance with the current measurement values at the shaft part 10, specifically during the complete grinding process, until the finished dimension, i.e. the final dimension is achieved.

By means of the method according to the invention or by means of the system according to the invention, it is possible to grind both smooth shafts and what are called recessed, i.e. stepped shafts. The number of support disks that define the respective direct partial support locations, as well as the corresponding configuration of the support ruler can be flexibly established, depending on the workpiece shape, workpiece dimensions, and the like. The speeds of rotation of the support disks 2, 2' and of the workpiece headstock 13 must be continuously monitored and adjusted, if necessary, since the current diameter of the shaft part 10 changes continuously during grinding, and no slip is supposed to occur between the shaft part 10 and the support disks 2, 2'. Since the diameters of grinding disk and support disks 2, 2' are generally different, the corresponding circumference speeds of the support disks and the grinding disk must be continuously adjusted with respect to the mantle surface of the shaft part 10.

Figure 4:
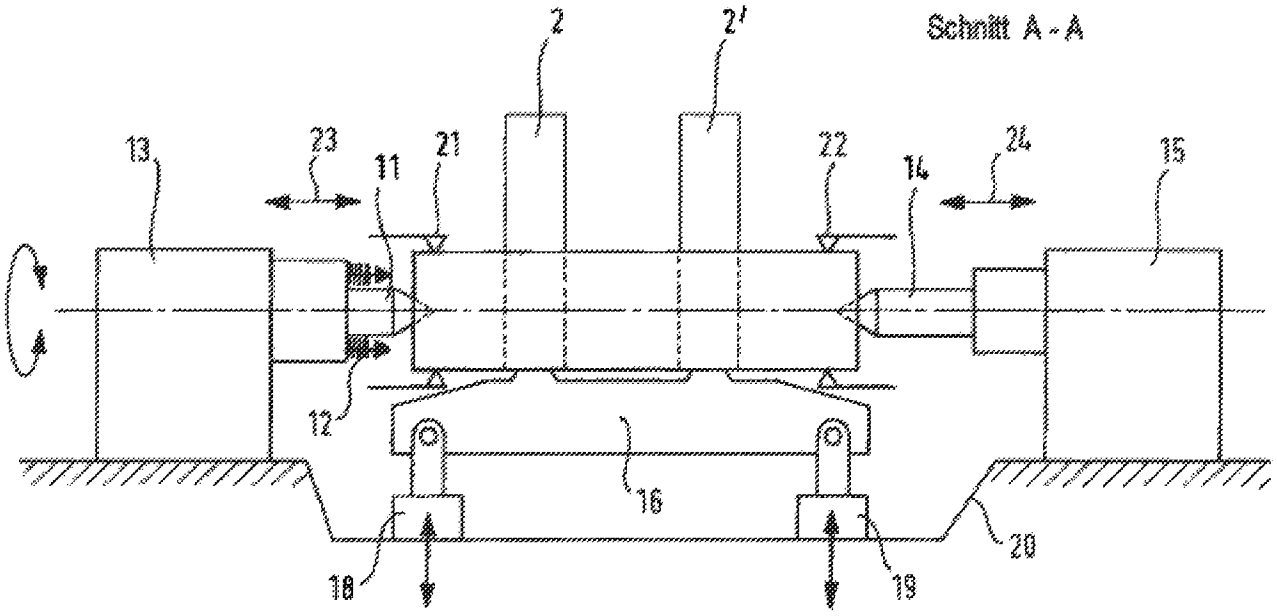
FIG. 4: a view as in FIG. 3, but with retracted drivers.

In FIG. 4, a view as according to FIG. 3 is shown, but with the difference that the drivers 12 for rotational drive of the shaft part 10 are retracted in the finishing grinding shown in FIG. 4. In this regard, according to the invention, the tips 11, 14 and the two support disks 2, 2', as well as the support ruler 16 are permanently set against the shaft part 10, i.e. they touch the shaft part 10 and support it. In this case, drive takes place not by way of the workpiece headstock 13, but rather by means of the grinding disk 1 (not shown) and the support disks 2, 2', wherein the shaft part 10 nevertheless remains completely clamped between the tips 11, 14 even during this phase. In this case, as well, the two measurement heads 21, 22 lie against the shaft part, so that the current shaft part diameter can be continuously measured during the process, and on the basis of these measurement values for the respective current diameters, the support disks 2, 2' and the support ruler 16 can be continuously set to the precise reference position.

Only for loading and unloading shaft parts or workpieces 10 into or from the system according to the invention are the tips 11, 14 retracted, specifically along the displacement axles 23 and 24, so that a finished ground shaft part 10 can be removed from the grinding machine.

Figure 5:
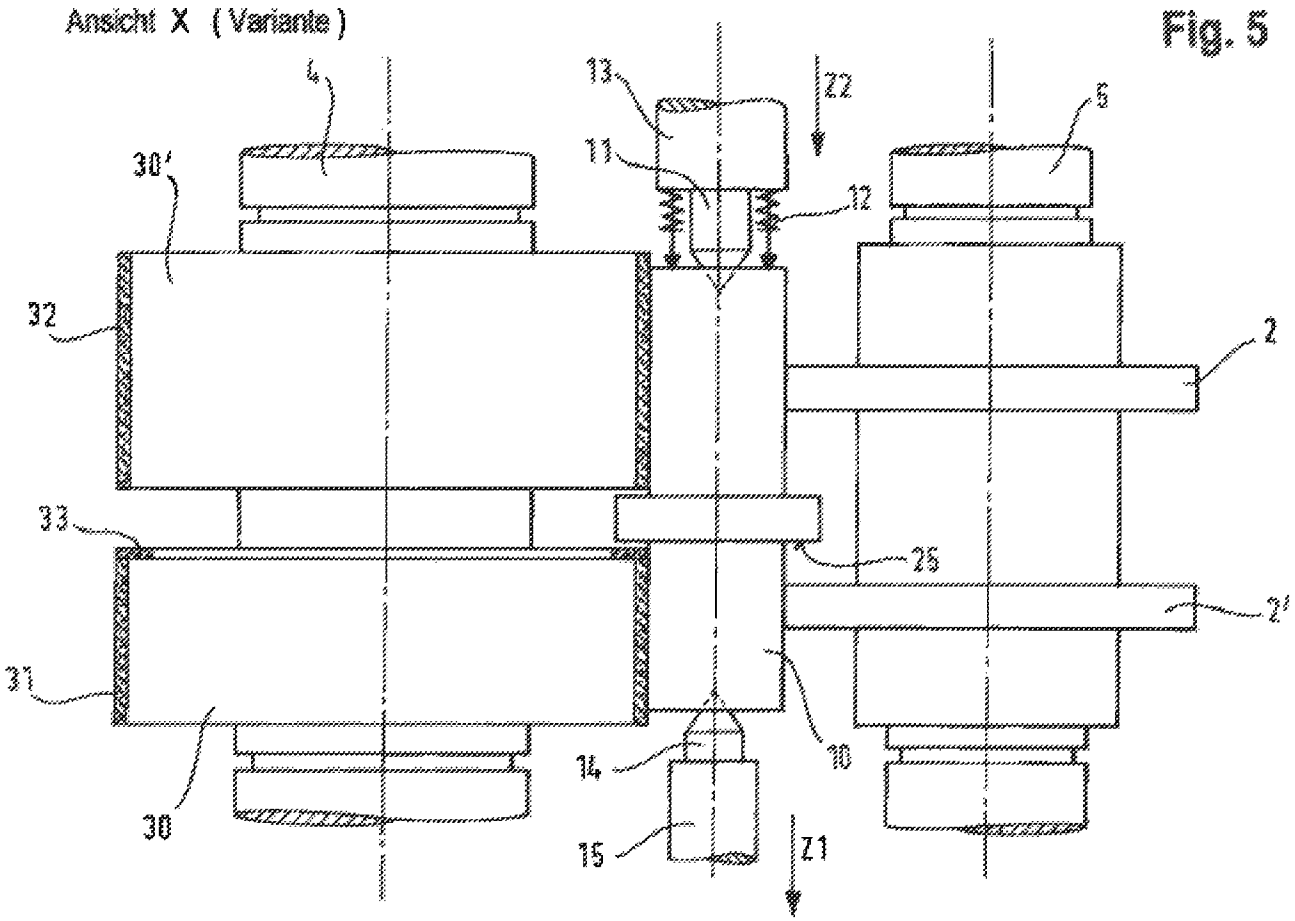
FIG. 5: a grinding machine according to the invention, with a shaft part that is modified as compared with FIG. 2, and a grinding disk correspondingly adapted to it, in the same view as FIG. 2.

In the exemplary embodiment according to FIG. 5, the fundamental arrangement of which corresponds to that according to FIG. 2, once again the shaft part 10 is clamped between the tips 11, 14 during the entire grinding process, wherein the drivers 12 on the workpiece headstock 13 ensure that the shaft part 10 is rotationally driven during the grinding process. Once again, two support disks 2, 2' are disposed on the support spindle 5, which disks support the shaft part 10 in its center region, on the side opposite the grinding disk engagement. In the case of the shaft part according to FIG. 2, only one continuous rotationally symmetrical section is provided over the entire length of the shaft part. In contrast, the shaft part 10 according to the exemplary embodiment according to FIG. 5 has a collar in its center region. This collar additionally has planar surfaces 25, which are also ground with the grinding disk. Because of the placement of a collar in the center region of the shaft part 10, the grinding disk is divided up into two partial grinding disks 30, 30'. The distance between the partial grinding disks, which are both disposed on the grinding spindle 4, is slightly greater than the width of the collar of the shaft part 10, which has the planar surfaces 25. The partial grinding disk 30 has a grinding coating 31, whereas the partial grinding disk 30' has a grinding coating 32.

In the present exemplary embodiment, the partial grinding disk 30 additionally has a grinding coating on its end face, which faces the partial grinding disk 30. The end face grinding coating 33 provided there serves to grind the collar disposed on the shaft part 10, in its center region, with regard to its planar surface 25. In addition, it can be provided that the partial grinding disk 30' also has such an end face grinding coating, which is then disposed on the end face of the partial grinding disk 30' that faces the partial grinding disk 30. So that the planar surface 25 on the collar of the shaft part 10 can be ground, it is provided that the grinding disk 30, 31 and the workpiece 10 or the shaft part 10 perform a relative movement in relation to one another in the longitudinal direction of the shaft part 10. In the present exemplary embodiment according to FIG. 5, the workpiece headstock 13 with its tip 11 and the tailstock 15 with its tip 14 are automatically displaceable under CNC control. In this way, the result is achieved that the shaft part 10 is set against the grinding coating 33 of the partial grinding disk with its planar side 25, and thereby the planar side 25 can be ground. In this regard, grinding of the planar side takes place parallel in terms of time, at least in part. However, it is also possible that not only the rotationally symmetrical circumference sections and the planar side 25 are ground completely parallel in terms of time. In contrast, if the workpiece headstock 13 or the tailstock 15 is not adjustable in the axial direction, the grinding spindle 4 with its partial grinding disks 30, 30' can also be axially displaced, according to an embodiment that is not shown. In the exemplary embodiment according to FIG. 5, the axial displacement of the workpiece headstock is brought about by a CNC-controlled Z2 axle, and that of the tailstock 15 by means of a Z1 axle, which is also under CNC control. Preferably, CBN is used as a coating.

Figure 6:
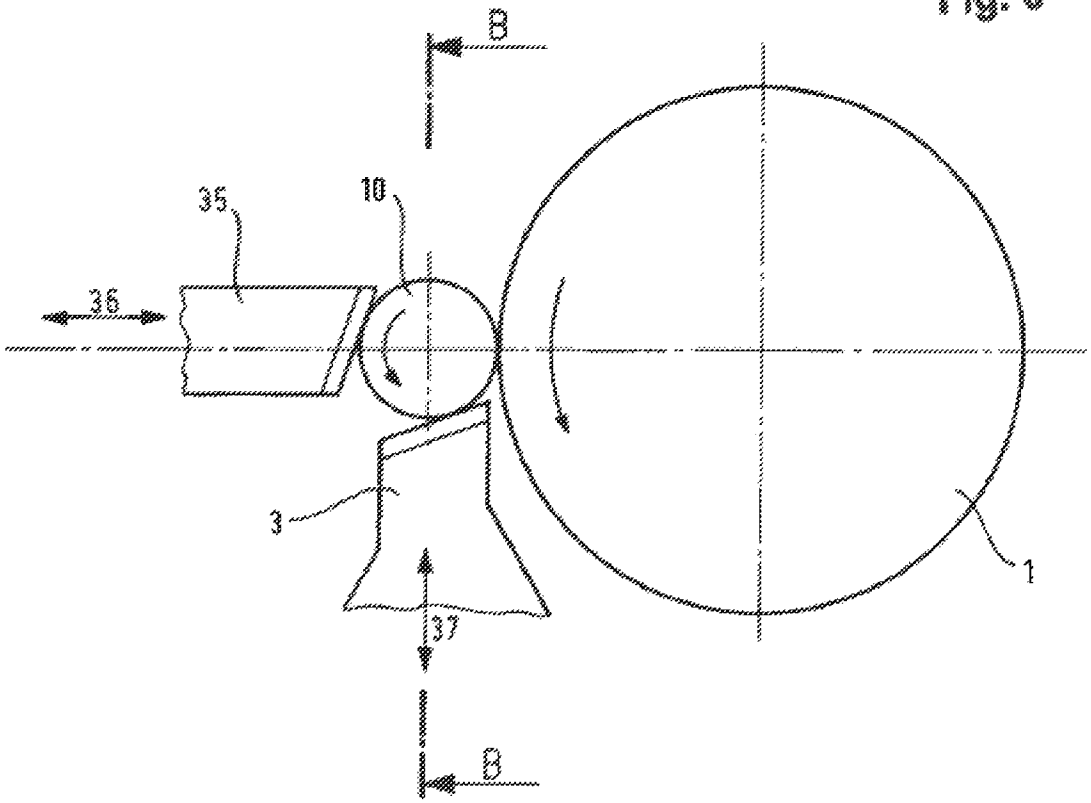
FIG. 6: a side view as in FIG. 1, with a support device that consists of two contact rulers.

In FIG. 6, a further exemplary embodiment is shown in a fundamental diagram that corresponds to that according to FIG. 1. In this exemplary embodiment, the shaft part 10 is once again ground by means of the grinding disk 1. In place of the first support unit in the form of a support disk, a support ruler 35 is provided, so that the support of the shaft part 10 during grinding is reliably supported during grinding, with permanent clamping between tips, by means of two support rulers, the support ruler 3 (second support unit) and the support ruler 35 (first support unit). Both the support ruler 3 and the support ruler 35 can not only be set against the shaft part 10 by way of respective CNC-controlled setting axles 36, 37, but also can be actively updated with respect to the currently measured active. Both support rulers 3, 35 are structured to be wear-resistant at their support surface, and this is particularly implemented by means of a PCD (polycrystalline diamond) coating. Setting or updating of the support rulers 3, 35 with respect to the respective current diameter of the shaft part 10 take place as a function of one another, so that reliable support of the workpiece 10 can be implemented during the entire grinding process, with permanent clamping between tips. The two support rulers 3, 35 form a prism that approximates a V shape, based on their setting or updating with respect to the current diameter of the shaft part 10, which take place as a function of one another. The drivers 12, not shown, must also engage on the workpiece in order to achieve the finished dimension in this exemplary embodiment, so that rotational drive of the shaft part 10 is guaranteed during the entire grinding process.

Figure 7:
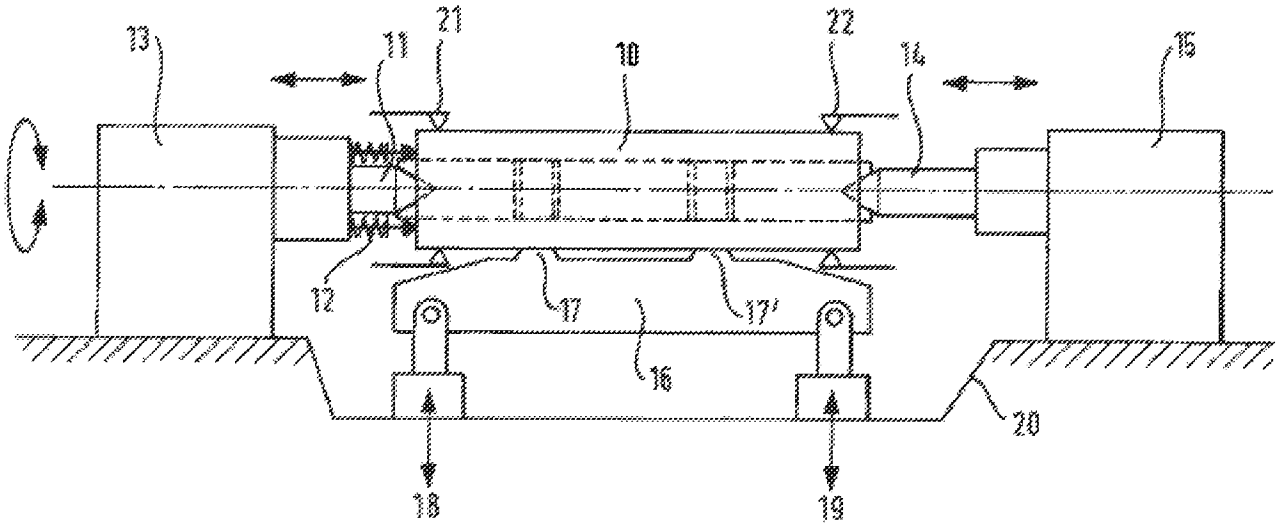
FIG. 7: a view along the section plane B-B according to FIG. 6.

FIG. 7, finally, represents a representation that is analogous to FIGS. 3 and 4, which shows a view along the section plane B-B according to FIG. 6. In this FIG. 7, it is shown that the two support rulers 3, 35 each form a partial support for the shaft part 10. The fundamental function, in which the tips 11, 14 clamp the workpiece in place during the entire grinding process, is implemented in this exemplary embodiment, as well.

The invention claimed is:

1. A method for grinding the exterior of a shaft part with rotationally symmetrical sections and end surfaces into which centering bores have been introduced, which bores define a reference longitudinal axis and rotational axis of the shaft part, wherein during grinding, up to the end of finishing grinding by means of a grinding disk, the shaft part is held between tips that engage into the centering bores, and supported on the rotationally symmetrical sections by means of a support device with a first and a second support unit, wherein the shaft part is disposed between the grinding disk and a first support unit of the support device, and a measurement device is an in-process measurement device and measures diameter values of the rotationally symmetrical sections of the shaft part, transmits these measurement values to a controller, and this controller, on the basis of these measurement values, actively updates setting of the grinding disk with respect to the measured diameter values, and updates the support device, continuously supporting the rotationally symmetrical sections, all the way to the finished dimension of the shaft part, wherein the support device, as the first support unit, has a support disk or a contact ruler, and the second support unit has a contact ruler being configured as a support rail having separate support regions and is set against the shaft part by two drives, each CNC-controlled.

2. The method according to claim 1, wherein the shaft part is rotationally driven.

3. The method according to claim 1, wherein the support disk and the shaft part essentially run without slip relative to one another.

4. The method according to claim 1, wherein the grinding disk, the shaft part, and the support disk are regulated with regard to their respective speed of rotation.

5. The method according to claim 1, wherein the shaft part is driven/braked during finishing grinding, by means of the grinding disk and the support disk.

6. The method according to claim 1, wherein the support disk is configured with a coating in the manner of a grinding disk.

7. The method according to claim 1, wherein measuring of the diameter values takes place by means of at least two measurement devices.

8. The method according to claim 1, wherein the support device has two contact rulers, which are adjusted relative to one another and are configured in the form of a prism.

9. The method according to claim 1, wherein the grinding disk and the shaft part are moved axially relative to one another, and in this regard, the shaft part is ground on the rotationally symmetrical section, on a planar side, at least partially parallel in terms of time.

10. The method according to claim 1, wherein the support disk is configured as a regulation disk, and the rotationally driven shaft part run essentially without slip relative to one another, wherein the grinding disk, the shaft part, and the regulation disk are regulated in terms of their speed of rotation.

11. The method according to claim 10, wherein the shaft part is driven during finishing grinding by means of the grinding disk and the regulation disk, wherein the grinding disk and the regulation disk form a grinding gap in which the shaft part is disposed, supported on the support rail.

12. The method according to claim 1, wherein two support rails are adjusted relative to one another and form a prism as the support device that is updated with respect to the respective current ground diameter.

13. A system composed of a grinding machine and a shaft part, for grinding the exterior of the shaft part, with rotationally symmetrical sections and end surfaces with centering bores introduced into them, which bores define a reference longitudinal axis and rotational axis of the shaft part, with a grinding disk that is disposed on a grinding spindle and is rotationally driven by way of a CNC axle, with a workpiece headstock having a first tip, and a tailstock having a second tip, wherein the shaft part is driven so as to rotate, by means of the first and second tip, during grinding, about a reference longitudinal axis defined in this way, and permanently held, wherein a support device having a first and a second support unit, which are adjustable relative to one another, and a measurement device are provided, by means of which measurement signals of the current diameter of the rotationally symmetrical section of the shaft part can be passed on to a controller, and on the basis of which the first and the second support unit can constantly be updated with respect to the current diameter of the rotationally symmetrical section, all the way to the finished dimension, in such a manner that the shaft part is doubly supported by means of the support units that lie opposite the grinding disk, and by means of the tips that are constantly in engagement, wherein the first support unit is a support disk or a contact ruler, and the second support unit is a contact ruler being configured as a support rail having separate support regions and is set against the shaft part by two drives, each CNC-controlled.

14. The system according to claim 13, wherein the grinding disk, the support disk, and the shaft part can each be regulated in terms of their speed of rotation, with CNC control.

15. The system according to claim 13, wherein the support disk sits on a spindle and is divided, and that each part can be updated with respect to the current diameter of corresponding rotationally symmetrical sections of the shaft part, supporting these sections.

16. The system according to claim 13, wherein the first support unit is a contact ruler, and the second support unit is a further contact ruler, which can be moved relative to the contact ruler, forming a prism-like support region on the rotationally symmetrical section of the shaft part.

17. The system according to claim 13, wherein the measurement device is an in-process measurement device.

18. The system according to claim 13, wherein drivers are present on the workpiece headstock, by means of which drivers the shaft part can be rotationally driven, and which can be released from engagement on the shaft part.

* * * * *